US010556723B2

(12) United States Patent
Lee

(10) Patent No.: US 10,556,723 B2
(45) Date of Patent: Feb. 11, 2020

(54) COVER ASSEMBLY FOR PROTECTING CHEMICAL CONTAINER

(71) Applicants: Jin Suk Lee, Cheongju-si, Chungcheongbuk-do (KR); Jae Heung Yoo, Anseong-si, Gyeonggi-do (KR); Kwang Chul Kim, Yongin-si, Gyeonggi-do (KR)

(72) Inventor: Jin Suk Lee, Cheongju-si (KR)

(73) Assignees: Jin Suk Lee, Cheongju-si, Chungcheongbuk-Do (KR); Jae Heung Yoo, Anseong-si, Gyeonggi-Do (KR); Kwang Chul Kim, Yongin-si, Gyeonggi-Do (KR)

( * ) Notice: Subject to any disclaimer, the term of this patent is extended or adjusted under 35 U.S.C. 154(b) by 152 days.

(21) Appl. No.: 15/501,988

(22) PCT Filed: Aug. 7, 2015

(86) PCT No.: PCT/KR2015/008280
§ 371 (c)(1),
(2) Date: Feb. 6, 2017

(87) PCT Pub. No.: WO2016/021977
PCT Pub. Date: Feb. 11, 2016

(65) Prior Publication Data

US 2017/0225831 A1 Aug. 10, 2017

(30) Foreign Application Priority Data

Aug. 7, 2014 (KR) ..... 10-2014-0101787

(51) Int. Cl.
*B65D 23/08* (2006.01)
*B65D 81/02* (2006.01)
(Continued)

(52) U.S. Cl.
CPC ..... *B65D 23/0885* (2013.01); *B65D 23/104* (2013.01); *B65D 77/0486* (2013.01); *B65D 81/02* (2013.01); *B65D 85/302* (2013.01)

(58) Field of Classification Search
CPC .. B65D 23/0885; B65D 81/02; B65D 81/022; B65D 77/0486
See application file for complete search history.

(56) References Cited

U.S. PATENT DOCUMENTS 1,063,351 A 6/1913 Hyatt
1,712,228 A 5/1929 Payson et al.
(Continued)

FOREIGN PATENT DOCUMENTS

CN 2585821 Y 11/2003
CN 203186814 U 9/2013
(Continued)

OTHER PUBLICATIONS

International Search Report of PCT/KR2015/008280, dated Nov. 16, 2015, 2 pages.

*Primary Examiner* — Andrew T Kirsch
*Assistant Examiner* — Don M Anderson
(74) *Attorney, Agent, or Firm* — Hamre, Schumann, Mueller & Larson, P.C.

(57) ABSTRACT

A cover assembly for protecting a chemical container according to the present disclosure includes: a first cover member encompassing a part of an inner container; a second cover member encompassing the other part of the inner container; and a binding member for connecting the first cover member and the second cover member, wherein the binding member includes a binding body formed at any one of the first cover member and the second cover member and coupled to the other.

The cover assembly for protecting a chemical container, which is the present invention, is configured such that the
(Continued)

outside of a glass bottle accommodating a chemical is formed with a protection member capable of being separated into two or more layers, thereby suppressing a negative influence on the surroundings thereof by minimizing leakage of the solution to the outside even if the glass bottle is broken by an impact when a worker handles or moves the glass bottle.

6 Claims, 19 Drawing Sheets

(51) Int. Cl.

| | |
|---|---|
| ***B65D 85/30*** | (2006.01) |
| ***B65D 77/04*** | (2006.01) |
| ***B65D 23/10*** | (2006.01) |

(56) References Cited

U.S. PATENT DOCUMENTS

| | | | | |
|---|---|---|---|---|
| 4,300,612 | A | 11/1981 | Schroeder, Jr. et al. | |
| 5,692,631 | A | 12/1997 | Tillard et al. | |
| 6,793,076 | B1 | 9/2004 | Luo et al. | |
| 6,817,485 | B2 | 11/2004 | Kawai et al. | |
| 9,340,323 | B1 * | 5/2016 | Tate | B65D 23/001 |
| 2011/0024415 | A1 * | 2/2011 | Davtyan | B65D 21/0228 220/23.83 |

FOREIGN PATENT DOCUMENTS

| | | | |
|---|---|---|---|
| DE | 4126215 | C2 | 5/1993 |
| JP | S6458661 | A | 3/1989 |
| JP | H03114778 | U | 11/1991 |
| JP | H057639 | U | 2/1993 |
| JP | H06008250 | U | 2/1994 |
| JP | H06125969 | A | 5/1994 |
| JP | H09058715 | A | 3/1997 |
| JP | 2000247337 | A | 9/2000 |
| JP | 2007204105 | A | 8/2007 |
| JP | 2007302316 | A | 11/2007 |
| KR | 1020040056790 | A | 7/2004 |
| KR | 200386827 | Y1 | 6/2005 |
| KR | 100941409 | B1 | 2/2010 |
| KR | 1020140065874 | A | 5/2014 |
| KR | 1020150032029 | A | 3/2015 |

* cited by examiner

COVER ASSEMBLY FOR PROTECTING CHEMICAL CONTAINER

TECHNICAL FIELD

The present disclosure relates to a cover assembly for protecting a chemical container, and more particularly to a cover assembly for protecting a chemical container used in a semiconductor process.

BACKGROUND

Generally, purity is very important for chemicals used in a semiconductor manufacturing process, and, thus, the chemicals need to maintain high purity. Therefore, glass bottles recognized as being safest to maintain high purity have been mostly used.

The problem here is that a toxic chemical accommodated in the glass bottle may leak to the outside due to breakage of the glass bottle and then directly or indirectly cause contamination of humans, systems, facilities, and semiconductor products, and the glass bottle is highly likely to directly harm and hurt human skin or the like by its nature.

Actually, such glass bottles are very frequently moved to be coupled or removed in semiconductor manufacturing plants, and in such a case, many accidents of breakage of glass bottles have occurred and have been greatly reported in the media.

As described above, due to a greater concern over environment and safety in recent years, in case of leakage of a toxic material caused by breakage of a glass bottle accommodating a chemical, the workers may be physically damaged first and the semiconductor manufacturer's public image may also be damaged. Therefore, it is actually necessary to actively prepare for it.

Meanwhile, in recent years, the glass bottles have been substituted by plastic ones to solve the conventional problems of the glass bottles. However, containers made of plastic cannot completely maintain purity of a chemical solution due to elution. Therefore, the use of glass bottles is expected to last for a long time.

As a prior art document relating to suppression of leakage of a chemical solution which may occur when a glass container accommodating a chemical solution is damaged on move, U.S. Pat. No. 6,817,485 (Nov. 16, 2004) discloses methods for discharging high-purity chemicals from an inner container in a protective pressure container.

The above-described document provides a dual structure including a separate protective pressure container encompassing an inner container accommodating a chemical and discloses a method of stably discharging the high-purity chemical through a liquid discharge pipe placed inside the inner container, but does not disclose any structure relating to a method of separating the protective pressure container to expose the inner container accommodated in the protective pressure container and any method of suppressing leakage of the chemical by the protective pressure container in case of damage to the inner container.

DISCLOSURE OF THE INVENTION

Problems to be Solved by the Invention

The present disclosure is provided to solve the above-described conventional problems, and provides a cover assembly for protecting a chemical container which is configured such that the outside of a glass bottle accommodating a chemical is formed with a member combined into two or more separate layers, thereby suppressing a negative influence on the surroundings thereof by minimizing leakage of the chemical accommodated in the glass bottle to the outside even if the glass bottle is broken by an impact when a worker handles or moves the glass bottle.

Means for Solving the Problems

To this end, a cover assembly according to the present disclosure is a cover assembly for protecting an inner container accommodating a high-purity chemical used in a semiconductor manufacturing process, and includes a first cover member encompassing a part of the inner container; a second cover member encompassing the other part of the inner container; and a binding member that connects the first cover member and the second cover member, wherein the binding member includes a binding body formed at any one of the first cover member and the second cover member and coupled to the other.

Further, the cover assembly according to the present disclosure may further include a handle capable of being detached from any one of the first cover member and the second cover member.

Furthermore, in the cover assembly according to the present disclosure, the handle may be detached in the manner of opening an ice-cream cone.

Moreover, the cover assembly according to the present disclosure may further include a handle for moving which is integrally coupled to any one of the first cover member and the second cover member.

Further, in the cover assembly according to the present disclosure, if the handle for moving is provided in an even number, the even number of handles for moving may be arranged to face each other in pairs.

Furthermore, in the cover assembly according to the present disclosure, the binding member may further include a sealing member arranged between the first cover member and the second cover member.

Moreover, in the cover assembly according to the present disclosure, the binding body may be protruded in a stepwise manner from a lower end of the first cover member, and a step sill which the binding body protruded in a stepwise manner is engaged with and locked in may be formed at an upper end of the second cover member.

Further, in the cover assembly according to the present disclosure, the binding body may be formed into a protrusion protruded from the first cover member toward the second cover member, and a subsidiary binding body protruding toward the binding body to be alternately arranged with the binging body in a vertical direction may be formed at an upper end of the second cover member.

Furthermore, in the cover assembly according to the present disclosure, the binding member may further include an extension part, and the extension part may be formed between the binding body and the first cover member and between the subsidiary binding body and the second cover member.

Moreover, in the cover assembly according to the present disclosure, the first cover member is provided to cover an outer peripheral surface of an upper end of the second cover member by its lower end, the binding body may be protruded in a saw tooth shape from an inner peripheral surface of the lower end of the first cover member, and a subsidiary binding body protruded in a saw tooth shape from the outer peripheral surface of the upper end of the second cover member may be formed at the outer peripheral surface of an upper end of the second cover member.

Further, in the cover assembly according to the present disclosure, the first cover member is provided to cover an outer peripheral surface of an upper end of the second cover member by its lower end, the binding body may be formed into a thread shape at an inner peripheral surface of the lower end of the first cover member, a subsidiary binding body may be formed into a thread shape to be engaged with the binding body at the outer peripheral surface of the upper end of the second cover member, and the first cover member and the second cover member may be coupled to each other by screw fastening of the first binding body and the subsidiary binding body caused by relative rotation of the first cover member and the second cover member.

Furthermore, in the cover assembly according to the present disclosure, multiple saw teeth may be slantly formed on a lower surface of the first cover member in the opposite direction of a rotation direction of the first cover member, and an engagement part to be engaged with the saw teeth may be slantly formed in a portion which is contacted with the multiple saw of the second cover member in the opposite direction of a rotation direction of the second cover member.

Moreover, in the cover assembly according to the present disclosure, each of the first cover member and the second cover member may be formed of a material including one of polyethylene (PE), polypropylene (PP), polystyrene (PS), polyvinylidene chloride (PVDC), polyethyleneterephthalate (PET), polymethylmethacrylate (PMMA), phenolic resins (phenolformaldehyde (PF)), melamine resins (melamine-formaldehyde (MF)), urea resins (ureaformaldehyde (UF)), polyacetal, polyoxymethylene (POM), polyformaldehyde, acrylic resins, polyamide/Nylon (PA/Nylon), polymethylpentene (PMP), polycarbonate (PC), polyvinylalcohol (PVA), polyvutene-1 (PB-1), butadien resins (BDR), acrylonitrile-butadienee styrene (ABS), acrylonitrile styrene (AS), polymethacrylstyrene (MS), polybutyleneterephthalate (PBT), polyarylsulfone (PASF), polyarylate (PAR), hydroxybutyl polyester (HBP), polyacrylonitrile (PAN), fluoro resins (FR) (PVDF, PTFE, FEP, PFA, ETFE, Teflon, ECTFE, PCTFE), polyphenyleneether (PPE), ionomer resins, fiber reinforced plastics (FRP), ethylenevinylacetate (EVA), methylmethacrylate-acrylonitrile-butadiene-styrene (MABS), polyethylenenaphthalate (PEN), silicone resins, epoxy resins, polyetherimide, polyphenylene sulfide (PPS), polyethersulfone (PES), poly(cyclohexane-1,4-dimethyleneterephthalate (PCT), ethylenevinylalcohol (EVOH), polyimide (PI), polyetheretherketone (PEEK), polylactide, polylactic acid (PLA), polybutylenesuccinate-co-adipate (PBSA), Ecozen, and TPE (Thermo Plastic Elastomer).

Further, the cover assembly according to the present disclosure may further include a third cover member arranged above the first cover member and the second cover member and encompassing an upper part of the inner container, and the third cover member may include a cap encompassing an inlet part of the inner container and a connection part connecting the cap to any one of the first cover member and the second cover member.

Furthermore, in the cover assembly according to the present disclosure, multiple buffering protrusions may be formed on inner surfaces of the first cover member and the second cover member, respectively, and the buffering protrusions may suppress vibration of the inner container caused by a micro gap formed between the inner container and the first cover member and between the inner container and the second cover member.

Effects of the Invention

The above-described cover assembly for protecting a chemical container, which is the present invention, is configured such that the outside of a glass bottle accommodating a chemical is formed with a protection member capable of being combined into two or more separate layers, thereby suppressing a negative influence on the surroundings thereof by minimizing leakage of the solution to the outside even if the glass bottle is broken by an impact when a worker handles or moves the glass bottle.

The present disclosure suppresses leakage of a high-purity chemical solution, such as photo resist, DSA (Directed Self Assembly), RELACS (Resolution Enhancement of Lithography by Assist of Chemical Shrink), SAFIER (Shrink Assist Film for Enhanced Resolution), BARC (Bottom Anti Reflection Coating), TARC (Top Anti Reflection Coating), Immersion Top Coating materials, SOD (Spin On Dielectric), Spin On Hard-mask (Spin On Carbon, Spin On Metal), MFHM (Multi Function Hard Mask), HMDS, Thinner (Solvent), Developer, Surfactant, Slurry, and the like, used in manufacturing a semiconductor when a glass bottle of the high-purity chemical solution is damaged.

Further, a processable transparent or opaque natural or synthetic resin is formed to be combined with a protection member including two or more separate layers. Thus, there is provided a method for minimizing or completely suppressing leakage of a chemical by encompassing the outside of a glass bottle.

MODE FOR CARRYING OUT THE INVENTION

Figure 1A:
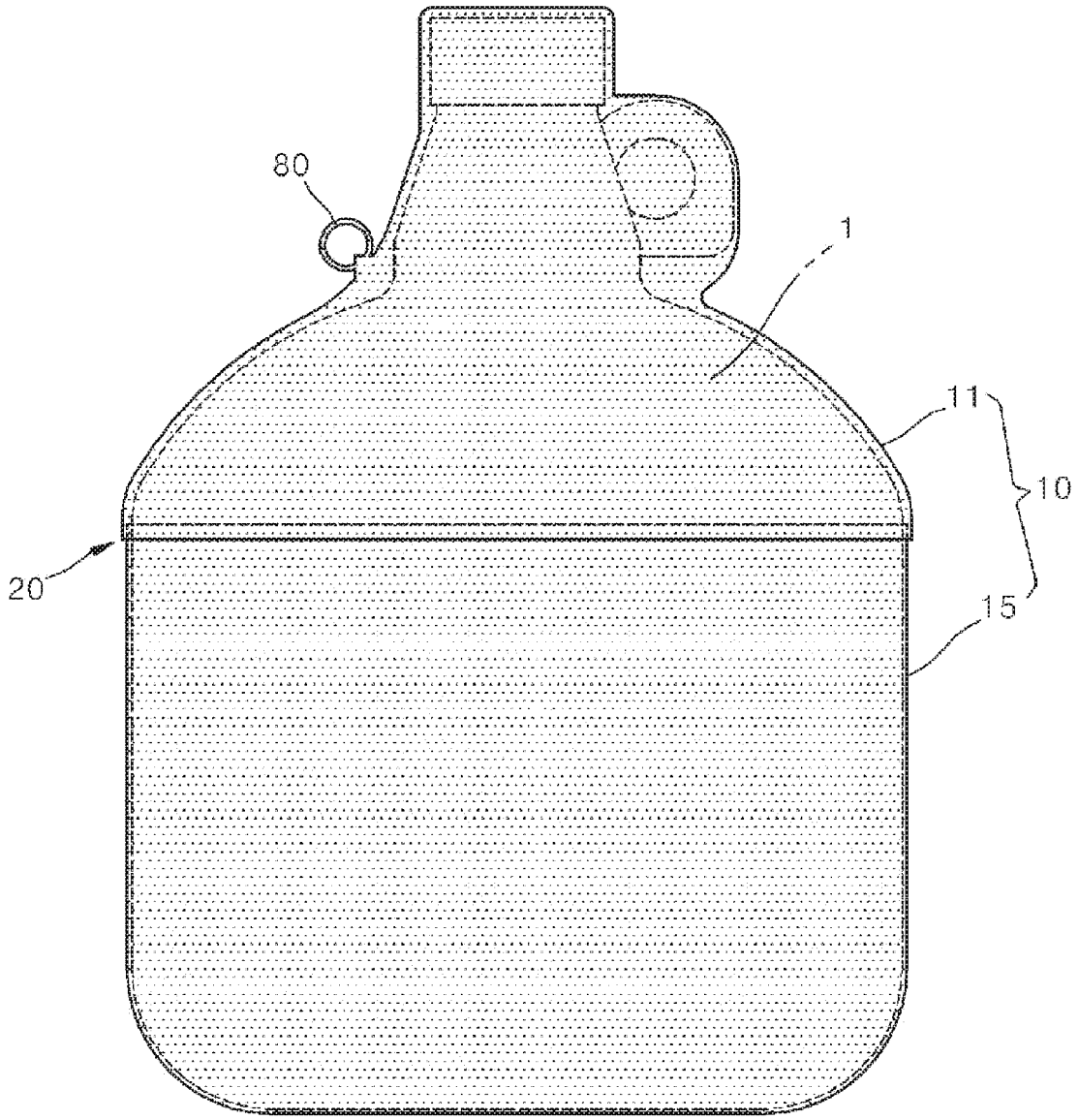
FIG. 1A is a cross-sectional view of a cover assembly for protecting a container in accordance with an exemplary embodiment of the present disclosure.

Hereinafter, exemplary embodiments of the present disclosure will be described in more detail with reference to the accompanying drawings. However, the present disclosure is not limited to the following exemplary embodiments but may be implemented in various different forms. The exemplary embodiments are provided only to complete disclosure of the present disclosure and to fully provide those skilled in the art with the category of the invention. Like reference numerals in the drawings generally denote like elements.

Figure 1B:
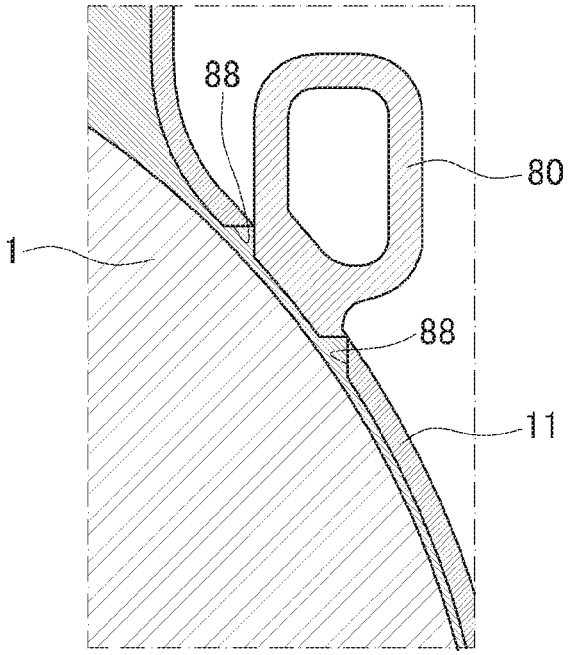
FIG. 1B is a conceptual cross-sectional view provided to explain a detachable handle.
Figure 1C:
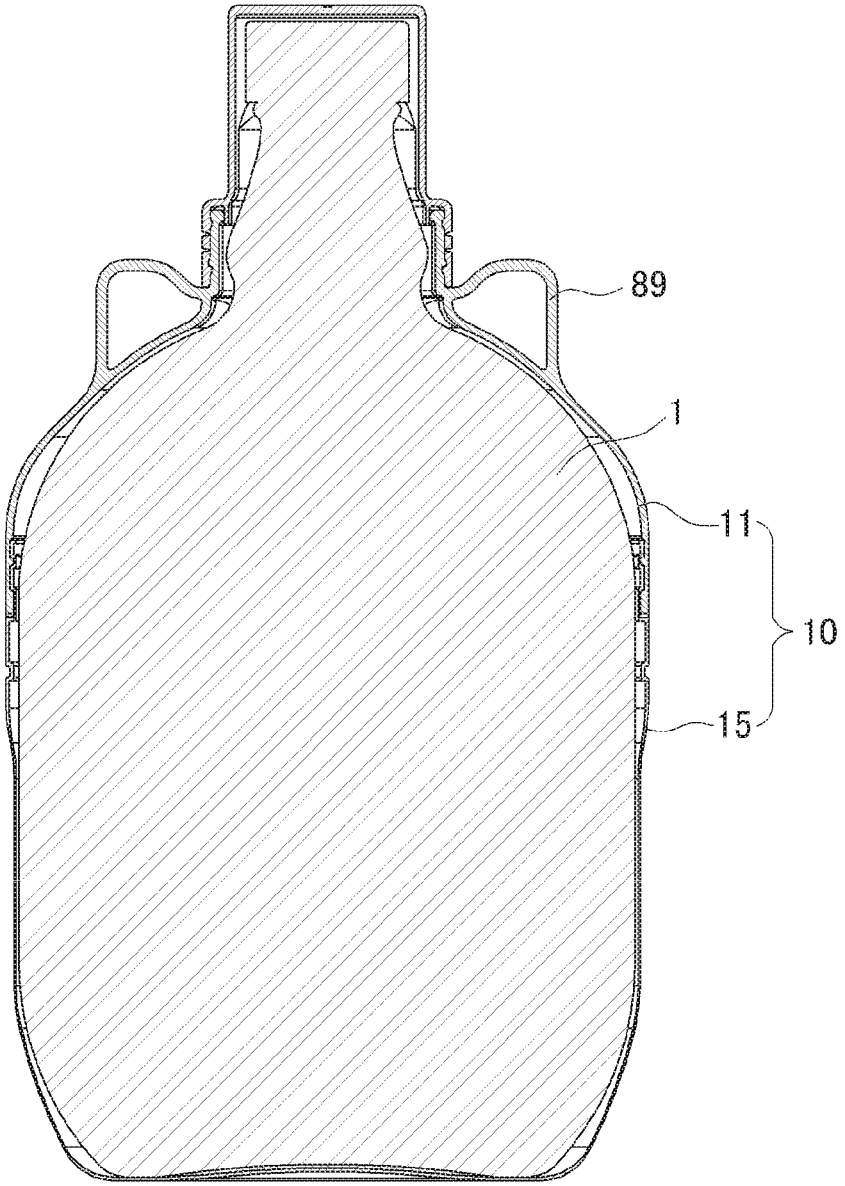
FIG. 1C is a cross-sectional view of a cover assembly for protecting a container including two handles in accordance with an exemplary embodiment of the present disclosure.
Figure 2:
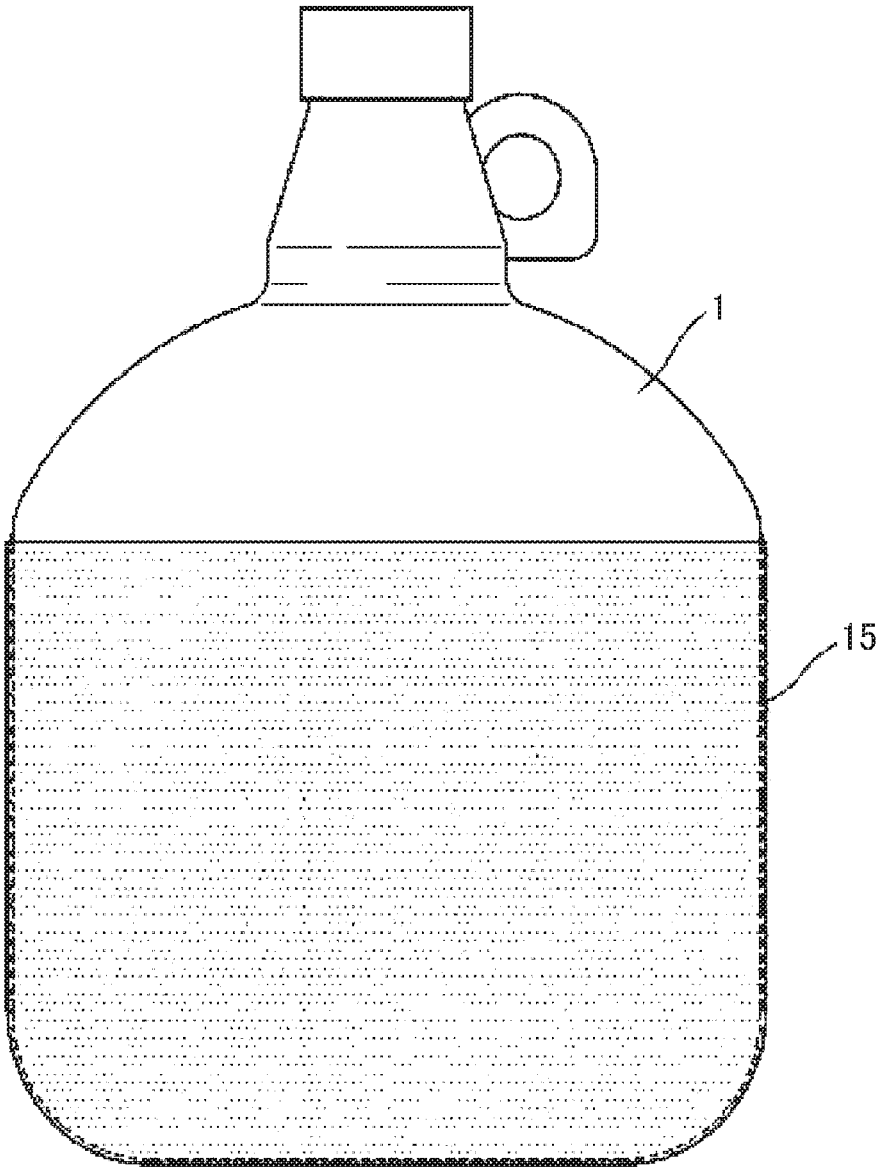
FIG. 2 is a diagram illustrating a state where an upper cover member is removed from the cover assembly of FIG. 1.

In order to solve the problems of the prior art, the present disclosure provides various exemplary embodiments of a cover assembly for protecting an inner container. FIG. 1A and FIG. 1C are cross-sectional views of a cover assembly for protecting a chemical container in accordance with an exemplary embodiment of the present disclosure, FIG. 18 is a conceptual cross-sectional view provided to explain a detachable handle, and FIG. 2 is a diagram illustrating a state where an upper cover member is removed from the cover assembly of FIG. 1. FIG. 3 through FIG. 10 illustrate engagement structures of cover assemblies in accordance with various exemplary embodiments of the present disclosure.

Firstly, a cover assembly for protecting a chemical container (hereinafter, referred to as "present assembly") in accordance with an exemplary embodiment of the present disclosure will be described.

As illustrated in FIG. 1A, the present assembly 10 includes a first cover member 11 encompassing a part of an inner container 1 accommodating a chemical, a second cover member 15 encompassing the other part of the inner container 1, and a binding member 20 encompassing the first cover member 11 and the second cover member.

In the present exemplary embodiment, it is disclosed that the cover assembly for protecting a chemical container is combined into the first cover member 11 and the second cover member 15, i.e., two separate layers. In some cases, the cover assembly for protecting a chemical container can also be combined into three or more separate layers.

In order to suppress a failure in tightening due to an air layer present between the present cover assembly 10 and the inner container 1 while the present cover assembly 10 which is integrally molded fits on the inner container 1, a separate air discharge groove (air path) may be formed on the first cover member 11 or the second cover member 15.

Further, multiple buffering protrusions 150 and 250 may be formed on inner surfaces of the first cover member 100 and the second cover member 100, respectively, of the present cover assembly. The buffering protrusions 150 and 250 function to suppress movement of the inner container caused by a micro gap which may be formed between the chemical container and the cover assembly. Further, the buffering protrusions 150 and 250 function to buffer an impact applied between the chemical container and the cover assembly.

Furthermore, the present disclosure may have a structure in which the first cover member 11 and the second cover member 15 are arranged at the front and rear of the cover assembly 10.

Each of the first cover member 11 and the second cover member 15 is configured to suppress leakage of the chemical in case of damage to the inner container 1 and thus needs to have an excellent chemical resistance and a predetermined rigidity or higher.

The followings are materials which can be used as a material of the first cover member 11 and the second cover member 15.

Ecozen, TPE (Thermo Plastic Elastomer), polyvinyl chloride resins (polyvinylchloride (PVC)), polyethylene (PE), polypropylene (PP), polystyrene (PS), polyvinylidene chloride (PVDC), polyethyleneterephthalate (PET), polymethylmethacrylate (PMMA), phenolic resins (phenolformaldehyde (PF)), melamine resins (melamineformaldehyde (MF)), urea resins (ureaformaldehyde (UF)), polyacetal, polyoxymethylene (POM), polyformaldehyde, acrylic resins, polyamide/Nylon (PA/Nylon), polymethylpentene (PMP), polycarbonate (PC), polyvinylalcohol (PVA), polyurethane (PU), polyvutene-1 (PB-1), butadiene resins (BDR), acrylonitrile-butadienee styrene (ABS), acrylonitrile styrene (AS), polymethacrylstyrene (MS), polybutyleneterephthalate (PBT), polyarylsulfon (PASF), polyarylate (PAR), hydroxybutyl polyester (HBP), polyacrylonitrile (PAN), fluoro resins (FR) (PVDF, PTFE, FEP, PFA, ETFE, Teflon, ECTFE, PCTFE), polyphenyleneether (PPE), ionomer resins, fiber reinforced plastics (FRP), ethylenevinylacetate (EVA), methylmethacrylate-acrylonitrile-butadiene-styrene (MABS), polyethylenenaphthalate (PEN), silicone resins, epoxy resins, polyetherimide, polyphenylene sulfide (PPS), polyethersulfone (PES), poly(cyclohexane-1,4-dimethyleneterephthalate (PCT), ethylenevinylalcohol (EVOH), polyimide (PI), polyetheretherketone (PEEK), polylactide, polylactic acid (PLA), polybutylenesuccinate-co-adipate (PBSA), cellophane rubber, paper or processed paper, metal, metal tube, wood, glass, ceramic, porcelain enamel, and starch.

According to the present cover assembly, the first cover member 11 and the second cover member 15 can be manufactured by combining any one or more of the above-described materials.

Referring to FIG. 1A, the first cover member 11 may be located on the second cover member 15.

FIG. 2 illustrates a state where the first cover member 11 from among the first cover member 11 and the second cover member 15 is removed from a surface of the inner container 1.

That is, a chemical is introduced into the inner container 1 and then the inner container 1 is sealed by the present cover assembly 10, and in this state, the inner container 1 may be transferred to a source of demand such as a semiconductor production line.

Further, the present cover assembly 10 includes a handle 80 formed at any one of the first cover member 11 and the second cover member 15.

After completion of the transfer, a worker separates the first cover member 11 from the second cover member 15 using the handle 80 integrally or individually coupled to the first cover member 11 in order to use the inner container 1.

Particularly, the handle 80 may be detachably formed at any one of the first cover member 11 and the second cover member 15. This is an example where the handle 80 is individually coupled to the first cover member 11.

The handle 80 may be detached from the first cover member 11 in the manner of opening an ice-cream cone. For example, referring to FIG. 1B, the first cover member 11 may include a hole into which an end of the handle 80 is inserted. In this case, a predetermined breakage groove 88 may be formed in an inner peripheral surface of the hole. Therefore, the hole has a minus tolerance that allows a frictional contact between the its inner peripheral surface and the end of the handle 80, and, thus, the entrance may be formed to have a smaller width than the inside. With this structure, the worker may detach the handle 80 from the first cover member 11 in a similar manner to the manner of opening an ice-cream cone. One or more handles may be provided. For reference, FIG. 1A illustrates that the one handle 80 is provided.

Further, referring to FIG. 1C, in the present disclosure, after the present cover assembly 10 is coupled to an outer surface of the inner container 1, a separate handle for moving 89 may be coupled in order to move the completely assembled container 1. Multiple handles for moving 89 may be provided. Particularly, the handles for moving 89 may be provided in an even number. In this case, the even number of handles for moving 89 may be arranged to face each other in pairs. For example, as illustrated in FIG. 1B, two handles for moving 89 may be provided. In this case, the two handles for moving 89 may be arranged to face each other.

Hereinafter, various exemplary embodiments of the binding member connecting the first cover member 11 and the second cover member 15 constituting the present cover assembly 10 will be described with reference to FIG. 3 through FIG. 10.

Figure 3:
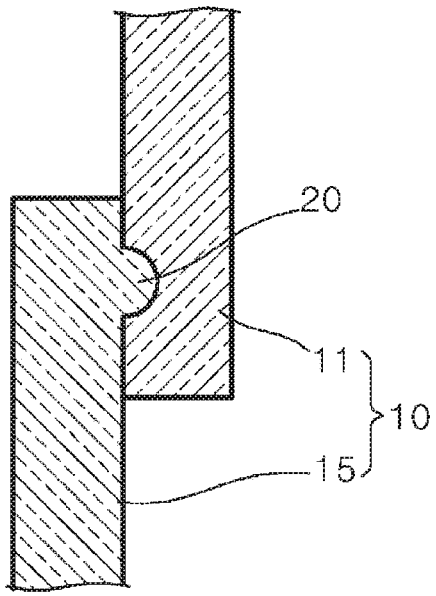
FIG. 3 illustrates an engagement structure of a cover assembly in accordance with a first exemplary embodiment of the present disclosure.

As illustrated in FIG. 3, in a first exemplary embodiment of the binding member, a binding body 20 protruded from the inside of the second cover member 15 may be coupled on an engagement groove formed in the inside of the first cover member 11.

Figure 4:
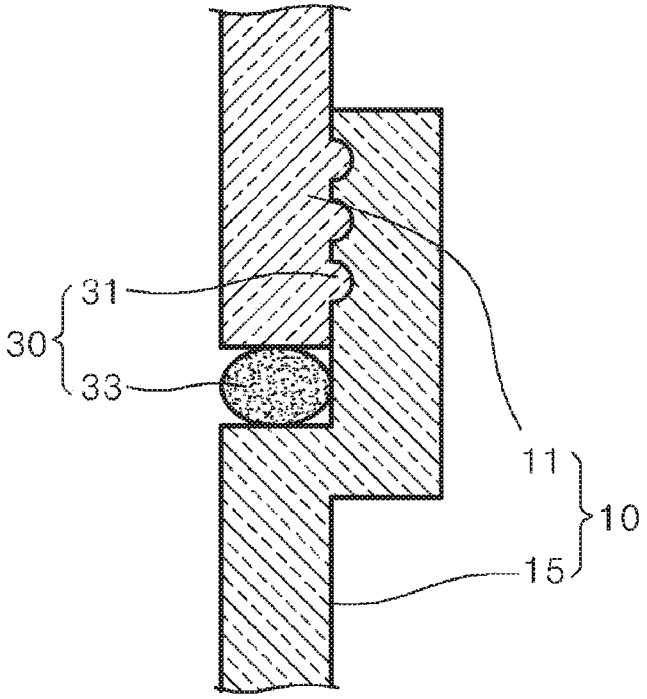
FIG. 4 illustrates an engagement structure of a cover assembly in accordance with a second exemplary embodiment of the present disclosure.

As illustrated in FIG. 4, in a second exemplary embodiment 30 of the binding member, a binding body 31 protruded from the inside of the first cover member 11 may be coupled to an engagement groove formed in the inside of the second cover member 15. In this case, the binding member 30 includes a separate sealing member 33 arranged between a lower end of the first cover member 11 and the second cover member 15.

Figure 5:
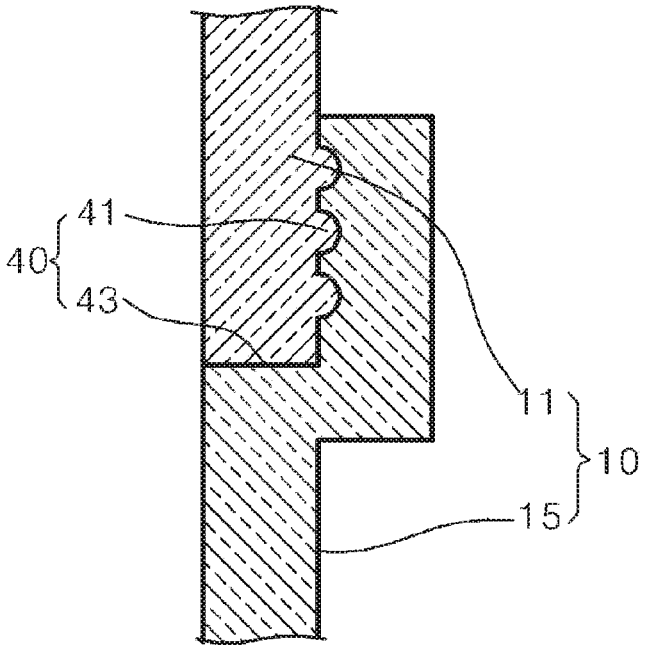
FIG. 5 illustrates an engagement structure of a cover assembly in accordance with a third exemplary embodiment of the present disclosure.

Meanwhile, in a third exemplary embodiment 40 of the binding member illustrated in FIG. 5, a binding body 41 protruded from the inside of the first cover member 11 may be coupled to an engagement groove formed in the inside of the second cover member 15 without a separate sealing member 33. In this case, a lower end 43 of the first cover member 11 is directly coupled on the second cover member 15.

Figure 6:
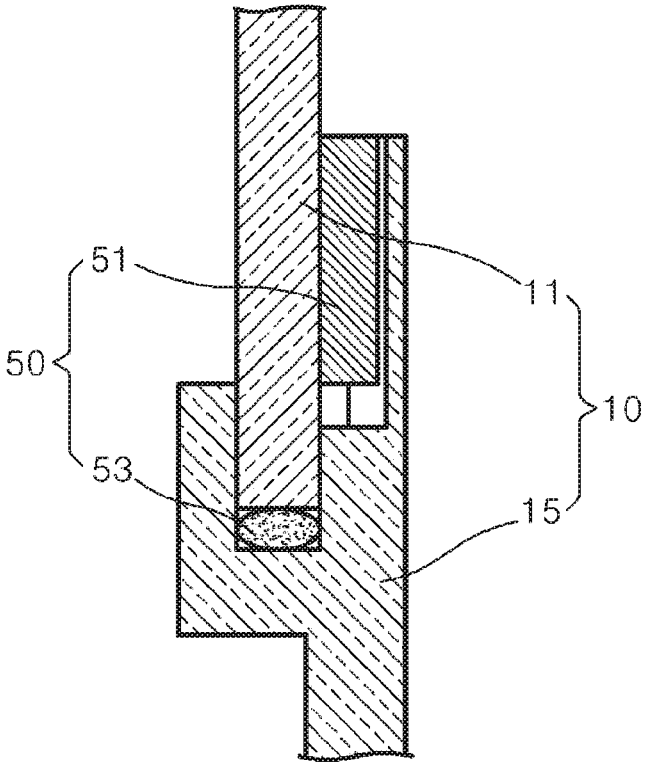
FIG. 6 illustrates an engagement structure of a cover assembly in accordance with a fourth exemplary embodiment of the present disclosure.

As illustrated in FIG. 6, in a fourth exemplary embodiment 50 of the binding member, a binding body 51 protruded from the inside of the first cover member 11 may be coupled on an engagement groove formed on the second cover member 15. The binding body 51 may have a structure in which a partial area of its upper end or lower end is protruded. The protruded part may correspond to a locking point separately formed in the engagement groove. In this case, the binding member 50 includes a separate sealing member 53 arranged between a lower end of the first cover member 11 and the second cover member 15. The sealing member 53 may have a structure mounted on a groove formed in an upper end of the second cover member 15.

Figure 7:
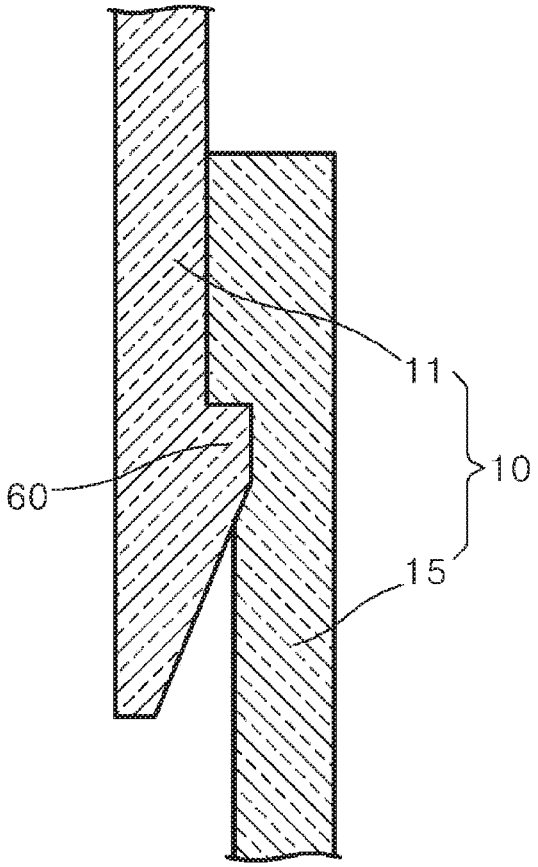
FIG. 7 illustrates an engagement structure of a cover assembly in accordance with a fifth exemplary embodiment of the present disclosure.

As illustrated in FIG. 7, in a fifth exemplary embodiment 60 of the binding member, a binding body protruded in a stepwise manner from a lower end of the first cover member 11 may be coupled on a lower end of a step sill formed on the second cover member 15.

Figure 8:
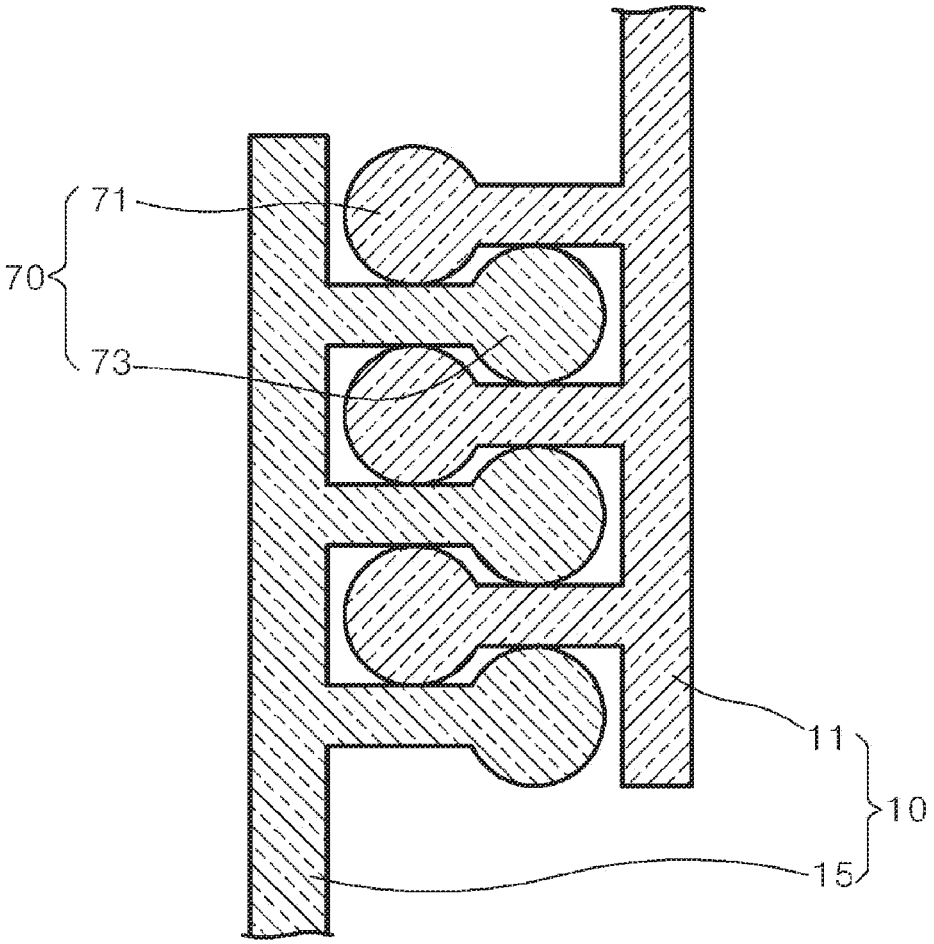
FIG. 8 illustrates an engagement structure of a cover assembly in accordance with a sixth exemplary embodiment of the present disclosure.

As illustrated in FIG. 8, in a sixth exemplary embodiment 70 of the binding member, a binding body 71 may be protruded from the inside of the first cover member 11 toward the second cover member 15. In this case, a subsidiary binding body 73 protruding toward the binding body 71 to be alternately arranged with the binging body 71 in a vertical direction may be formed at an upper end of the second cover member 15.

As illustrated in FIG. 8, the first binding body 71 and the subsidiary body 73 may be alternately arranged in a vertical direction. In this case, the binding member may include an extension part. The extension part may connect the first binding body 71 to the first cover member 11 and connect the second binding body 73 to the second cover member 15. This structure maintains a state where the first binding body 71 and the subsidiary binding body 73 are coupled to each other.

Figure 9:
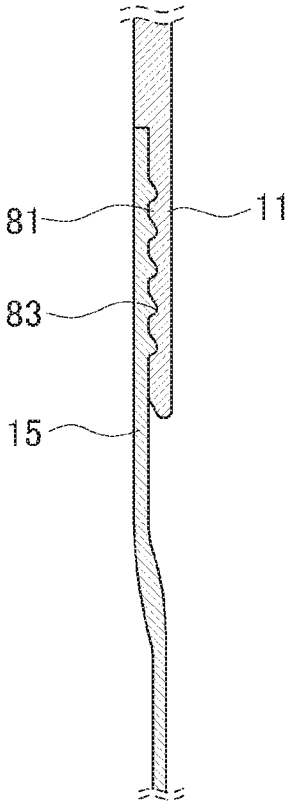
FIG. 9 illustrates an engagement structure of a cover assembly in accordance with a seventh exemplary embodiment of the present disclosure.

Further, as illustrated in FIG. 9 in a seventh exemplary embodiment of the binding member, the first cover member 11 may be provided to cover an outer peripheral surface of an upper end of the second cover member 15 by its lower end. In this case, a binding body 81 may be protruded in a saw tooth shape from an inner peripheral surface of the lower end of the first cover member 11. Further, a subsidiary binding body 83 may be protruded in a saw tooth shape from the outer peripheral surface of the upper end of the second cover member 15. The first cover member 11 and the second cover member 15 may be coupled to each other by engagement between the first binding body 81 and the subsidiary binding body 83.

Figure 10A:
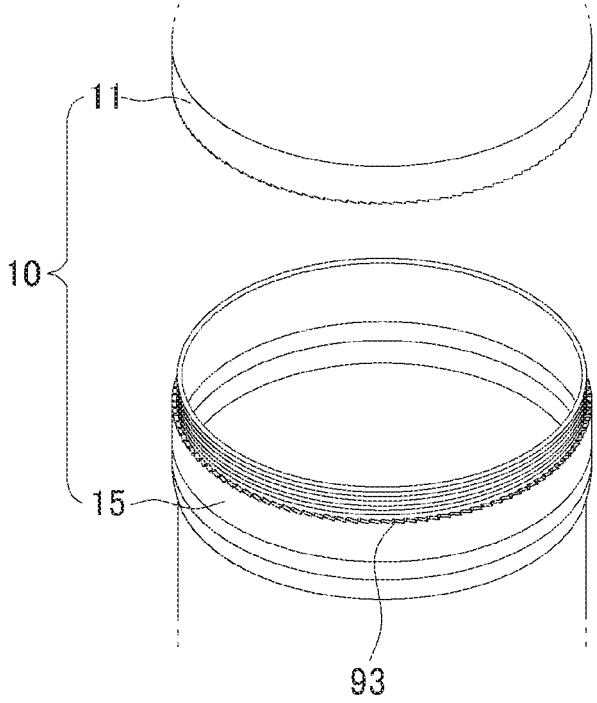
FIG. 10A illustrates an engagement structure of an uncoupled cover assembly in accordance with an eighth exemplary embodiment of the present disclosure.

Furthermore, as illustrated in FIG. 10A, in an eighth exemplary embodiment of the binding member, if the first cover member 11 is provided to cover an outer peripheral surface of an upper end of the second cover member 15 by its lower end, a binding body may be formed into a thread shape at an inner peripheral surface of the lower end of the first cover member 11. In this case, a subsidiary binding body may be formed at the second cover member 15. The subsidiary binding body 93 may be formed at the outer peripheral surface of the upper end of the second cover member 15 and formed into a thread shape to be engaged with the binding body. The first cover member 11 and the second cover member 15 may be coupled to each other by screw fastening of the binding body and the subsidiary binding body 93.

For screw fastening of the binding body and the subsidiary binding body 93, the first cover member 11 and the second cover member 15 may relatively rotate to each other. The relative rotation may refer to rotation of the first cover member 11 with respect to the second cover member 15 in a stationary state or rotation of the second cover member 15 with respect to the first cover member 11 in a stationary state, or rotation of the first cover member 11 and the second cover member 15 in opposite directions.

Figure 10B:
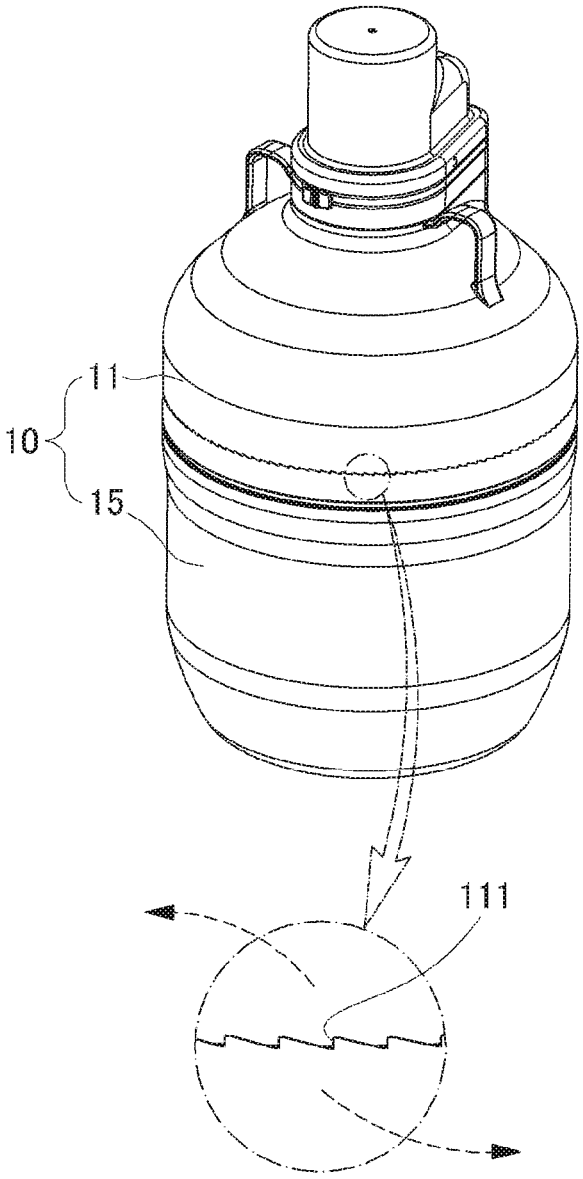
FIG. 10B illustrates the engagement structure of a coupled cover assembly in accordance with the eighth exemplary embodiment of the present disclosure.

Further, as illustrated in FIG. 10B, in the eighth exemplary embodiment, multiple saw teeth 111 may be slantly formed on a lower surface of the first cover member 11 in the opposite direction of a rotation direction of the first cover member 11, and an engagement part to be engaged with the saw teeth 111 may be slantly formed in a portion which is contacted with the multiple saw of the second cover member 15 in the opposite direction of a rotation direction of the second cover member 15. Therefore, since the first cover member 11 and the second cover member 15 may be closely engaged with each other, as long as a predetermined external force or higher is not applied thereto, the release of screw fastening of the first cover member 11 and the second cover member 15 can be suppressed.

Furthermore, the present cover assembly may include a third cover member arranged above the first cover member 11 and the second cover member 15 and encompassing an upper part of the inner container 1.

The third cover member may include a cap encompassing an inlet part of the inner container 1 and a connection part connecting the cap to any one of the first cover member 11 and the second cover member 15. The third cover member will be described in detail with reference to a cover assembly for protecting a chemical container in accordance with another exemplary embodiment of the present disclosure to be described below.

For reference, it is obvious that the components of an exemplary embodiment and another exemplary embodiment of the present disclosure may be cross-applied to each other.

Figure 11:
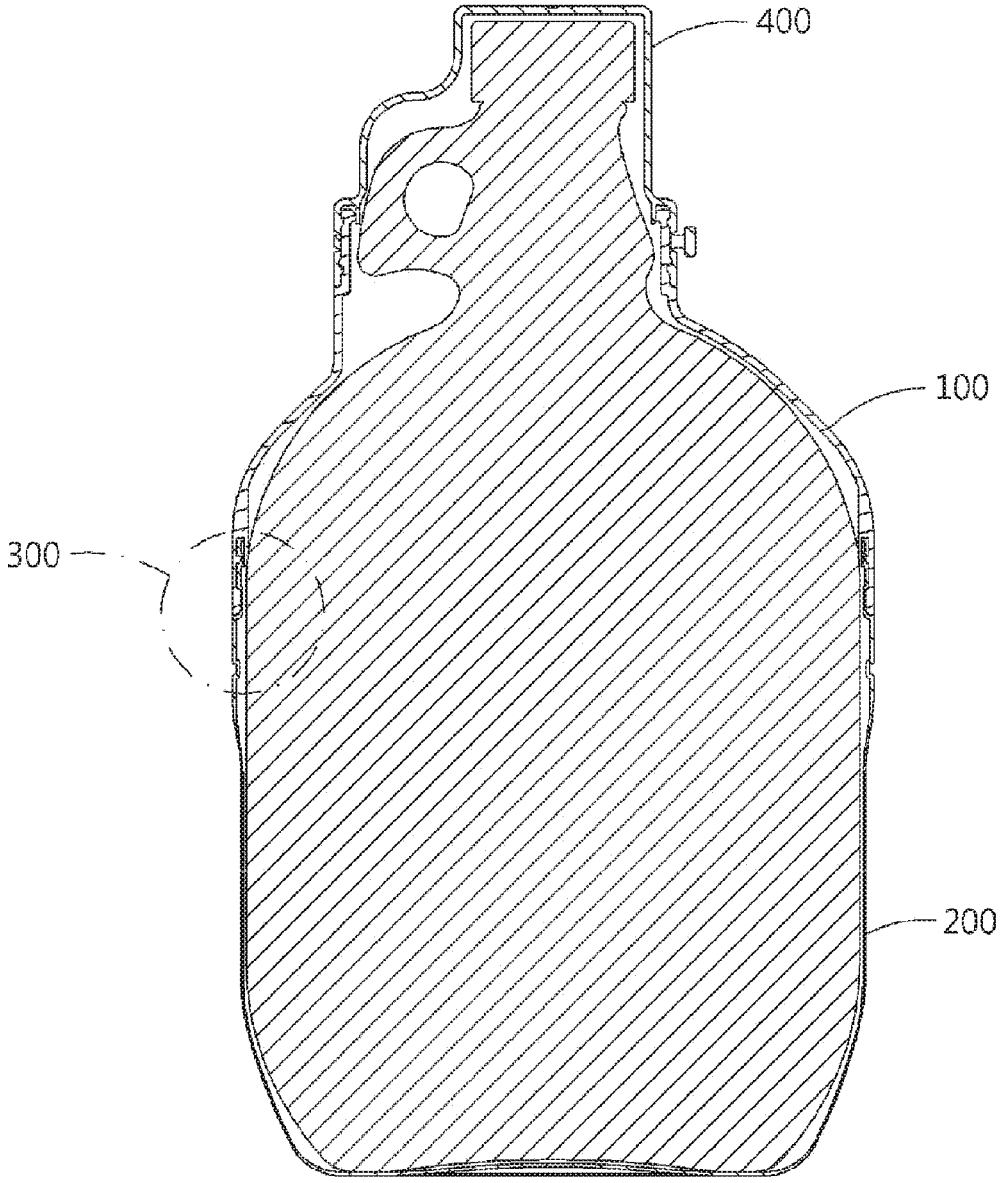
FIG. 11 is a cross-sectional view of a cover assembly for protecting a container in accordance with another exemplary embodiment of the present disclosure.
Figure 12:
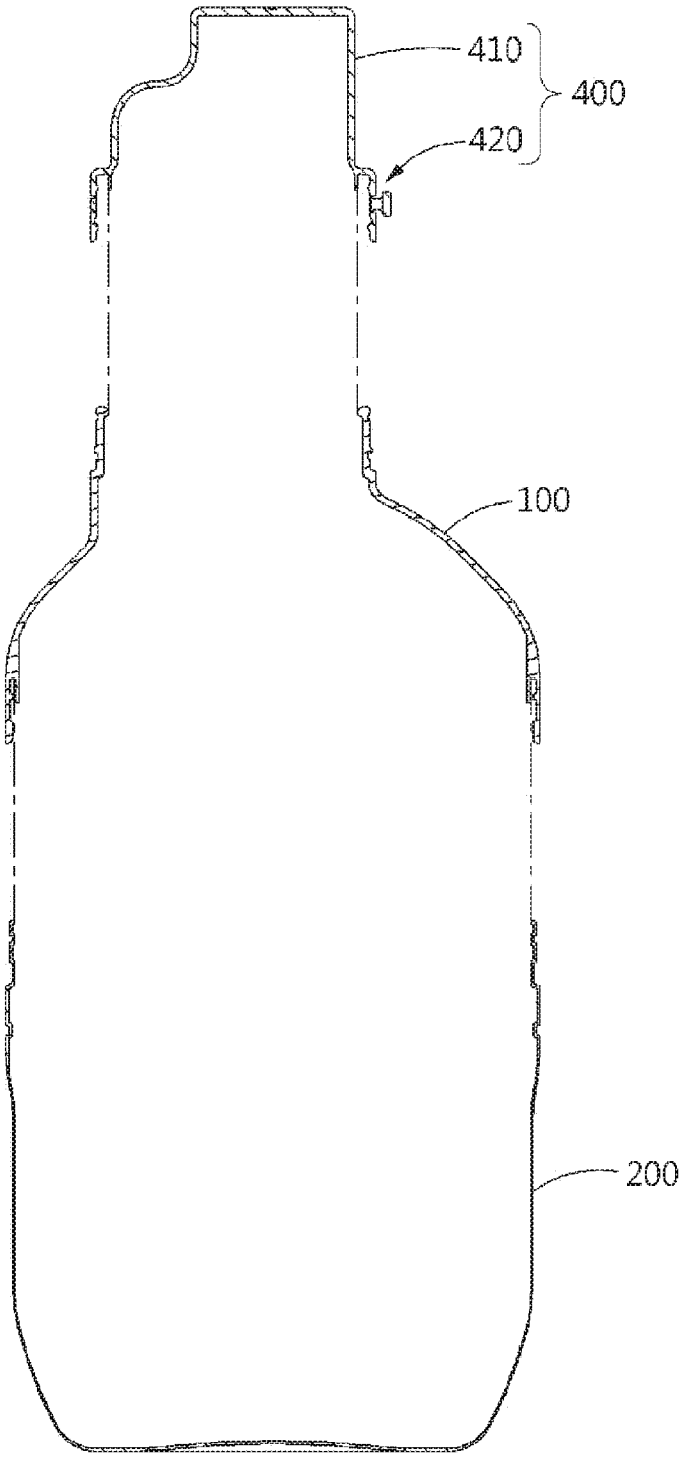
FIG. 12 is a diagram illustrating a state where an upper cover member, a lower cover member, and a cover member constituting the cover assembly of FIG. 11 are separated.

As illustrated in FIG. 11 and FIG. 12, a cover assembly for protecting a chemical container in accordance with another exemplary embodiment of the present disclosure is arranged to encompass an outer surface of the inner container 1 accommodating a chemical and specifically, includes a first cover member 100, a second cover member 200, a binding member 300 formed at an area where the first cover member 100 and the second cover member 200 are connected, and a third cover member 400 arranged above the first cover member 100.

The first cover member 100 and the second cover member 200 may have an inner diameter of a cross section in the range of, for example, from 168.2 mm to 171.5 mm, and a chemical container may be tightly accommodated therein. The first cover member 100 and the second cover member 200 may have a thickness of from 0.1 mm to 16.0 mm.

The first cover member 100 is a part encompassing an upper part of the chemical container and connected between the second cover member 200 and the third cover member 400 and protects the chemical container. A handle (not illustrated) may be formed at an upper part of an outer surface of the first cover member 100. Two or more handles may be formed at positions corresponding to each other.

The second cover member 200 is a part encompassing a lower part of the chemical container and completely seals a bottom surface of the chemical container. The second cover member 200 is extended to a middle part of the container and sealed by the first cover member 100 and the binding member 300. A transparent display window (not illustrated) for checking a water level in the container may be formed at the second cover member 200 in a height direction.

The first cover member 100 and the second cover member 200 may be formed to have the same inner diameter of the cross section in the range of from 168.2 mm to 171.5 mm. The binding member 300 connected to the first cover member 100 and the second cover member 200 can be formed at a part of the chemical container with the greatest outer diameter of the cross section. This is because if the first cover member 100 and the second cover member 200 has an inner diameter of the cross section of less than 168.2 mm, the chemical container is not suitable for a 1-gallon container, which is a standard chemical container used in a semiconductor process, and thus cannot be inserted therein, and if the first cover member 100 and the second cover member 200 has an inner diameter of the cross section of more than 171.5 mm, the chemical container can be easily inserted therein but can be shaken within the cover assembly and thus is in the risk of damage.

If the cover assembly is separated again when the chemical container is mounted on a semiconductor processing line, it takes time to separate the cover assembly from the chemical container, and the chemical container is likely to be damaged while being separated.

The first cover member 100, the second cover member 200, the binding member 300, and the third cover member 400 may be formed of plastic, and desirably may include any one material selected from the above-described material group for the cover member. The above-described materials are plastics which are not easily dissolved by the chemical stored in the chemical container even if the chemical container is damaged and have relatively great differences in solubility from chemicals used in a semiconductor process.

The first cover member 100 and the second cover member 200 may have a thickness in the range of 0.1 mm to 16.0 mm as described above. This is because if the first cover member 100 and the second cover member 200 has a thickness of less than 0.1 mm, the chemical may leak due to shards of glass resulting from breakage of the chemical container, and if the first cover member 100 and the second cover member 200 has a thickness of more than 16.0 mm, the chemical container cannot be mounted on a semiconductor processing line without separating the cover assembly.

The binding member 300 is an area where the first cover member 100 and the second cover member 200 are connected. The binding member 300 includes a first binding means formed along an arc at a lower end of the first cover member 100 and a second binding means formed along an arc at an upper end of the lower cover.

Referring to FIG. 12, the third cover member 400 is connected to an upper side of the first cover member 100 and seals an upper part of the chemical container. The third cover member 400 includes a cap 410 encompassing the upper part of the chemical container and a connection part 420 connecting the cap 410 to any one of the first cover member 100 and the second cover member 200. For example, the connection part 420 may connect the cap 410 to the first cover member 100. The cap 410 may encompass an inlet part of the inner container 1.

Figure 13:
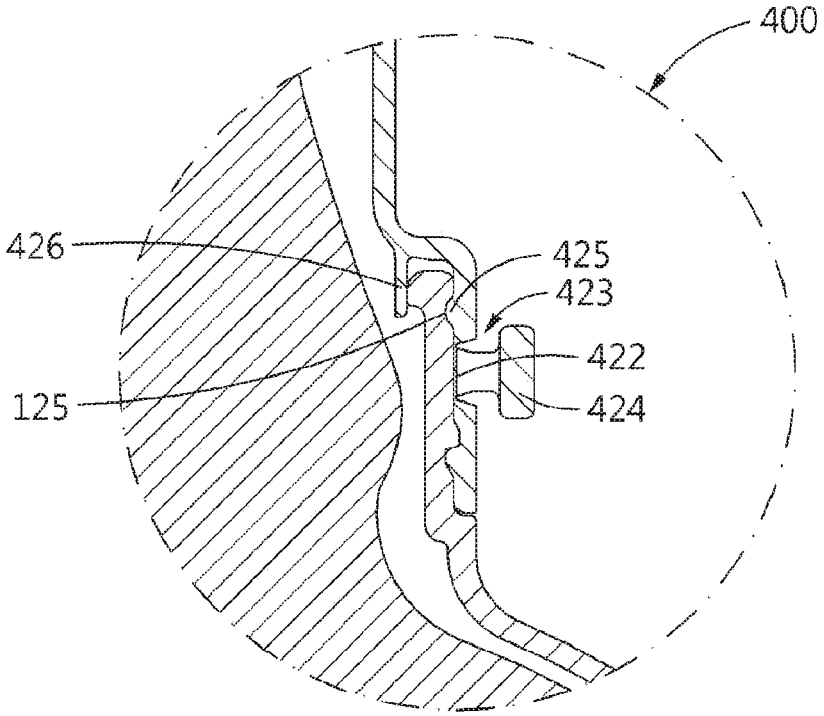
FIG. 13 is a diagram illustrating a configuration of the cover member.

As illustrated in FIG. 13, the third cover member 400 includes the cap 410 and the connection part 420, and the connection part 420 includes a ring for opening 422 on which a cutting groove 423 fractured along a circumferential direction and a protrusion part 424 coupled to one end of the ring for opening 422. Further, a binding protrusion 425 is formed in the connection part 420 and thus can be fixed as being coupled to an engagement groove 125 formed at an upper end of the first cover member 100. Otherwise, an engagement groove may be formed in the connection part 420, and a binding protrusion may be formed in the first cover member 100.

If the protrusion part 424 formed in the connection part 420 is applied with a force while being held by fingers, the ring for opening 422 is loosened by the cutting groove 423 formed along the circumferential direction, so that the first cover member 100 and the third cover member 400 are separated from each other.

The third cover member 400 includes the cap 410 tightly provided at the lid of the chemical container, so that there is a low risk of leakage. The connection part 420 to be rapidly removed to discharge the chemical for using the chemical is formed at the third cover member 400, so that it is possible to separate the third cover member 400 from the first cover member 100 more easily.

Further, a connection part lid 426 is formed at the connection part 420, so that it is possible to airtightly accommodate the upper end of the first cover member 100. In a state where the third cover member 400 and the first cover member 100 are connected by the connection part lid 426, the connection part lid 425 suppresses a dent toward the container or easy separation and makes it possible to maintain the shape.

The binding member 300 may be implemented as described below in addition to the examples described in an exemplary embodiment of the present disclosure.

The binding member 300 is formed by coupling the first binding means formed at the lower end of the first cover member 100 and the second binding means formed at the upper end of the second cover member 200, and any one of the first binding means and the second binding means may be a protruded binding protrusion 320 and the other may be a step sill 310 to be coupled to the binding protrusion 320. Further, an O-ring 330 may be further included between the step sill 310 and the binding protrusion 320.

Figure 14:
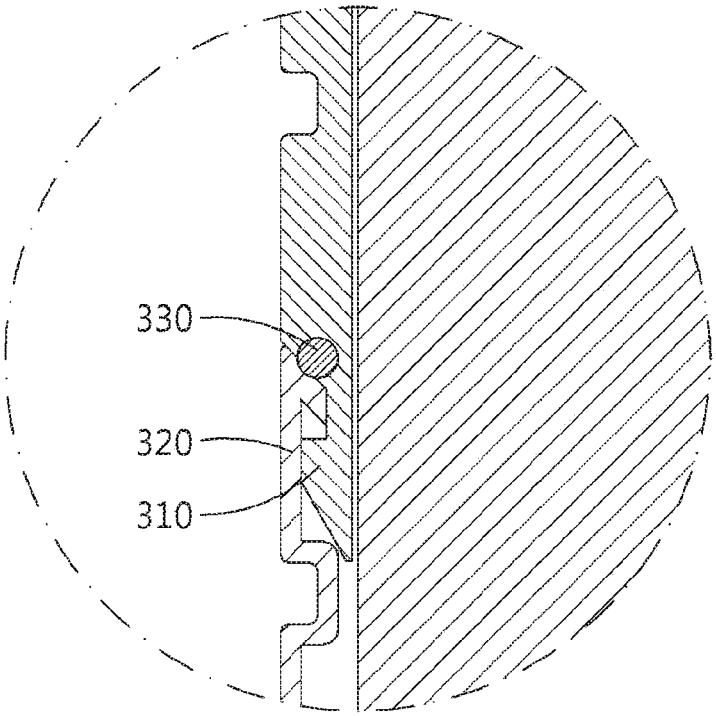
FIG. 14 illustrates an engagement structure of a cover assembly in accordance with a ninth exemplary embodiment of the present disclosure.

As illustrated in FIG. 14, the binding member 300 includes a binding body 310 formed into a step sill and a subsidiary binding body 320. However, the right scope of the present disclosure is not necessarily limited thereto.

The binding body 310 formed into a step sill may have an outwardly protruding sill shape and the subsidiary binding body 320 may have a diagonal line-shaped cross section, so that the first cover member 100 and the second cover member 200 can be easily coupled to each other but cannot be separated from each other.

Figure 15:
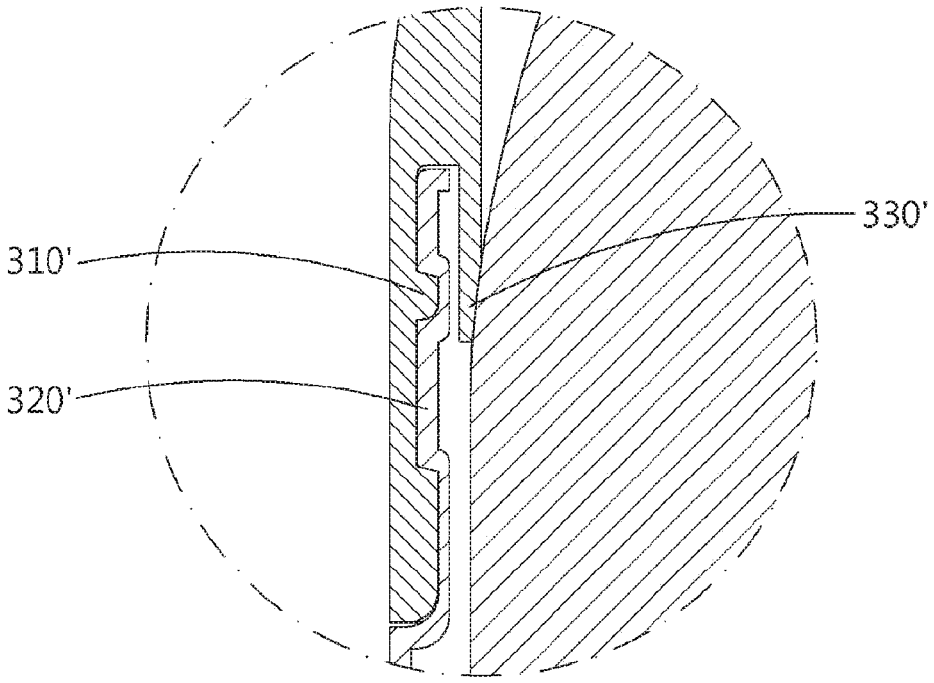
FIG. 15 illustrates an engagement structure of a cover assembly in accordance with a tenth exemplary embodiment of the present disclosure.

As illustrated in FIG. 15, a binding member 300' according to another exemplary embodiment of the present disclosure includes a binding body formed at the lower end of the first cover member 100 and a subsidiary binding body formed at the upper end of the second cover member 200.

The binding body includes an accommodation part 310' in which the subsidiary binding body 320 is accommodated and a binding lid 330', and includes a protrusion and a groove.

Further, the subsidiary biding body is formed at the upper end of the second cover member 200 and includes a protrusion and a groove like the first binding means. The subsidiary binding body includes an insertion biding body 320' to be inserted into a groove formed by the accommodation part 310' and the binding lid 330'.

That is, the binding body and the subsidiary binding body are coupled to each other by a protrusion and a groove formed corresponding to the accommodation binding part 310' and the insertion biding body 320', and the binding lid 330' may suppress a dent of the first cover member 100 toward the container.

Figure 16:
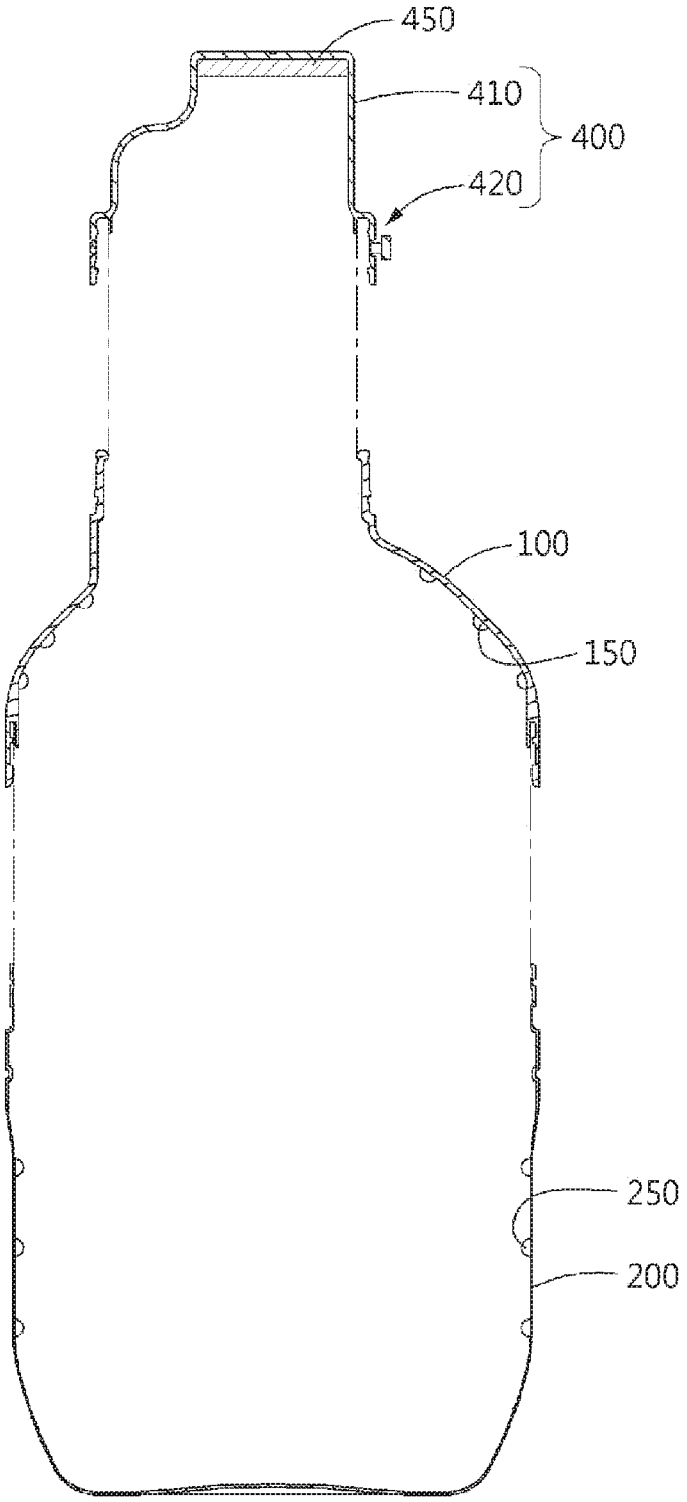
FIG. 16 is a cross-sectional view of a cover assembly for protecting a container in accordance with yet another exemplary embodiment of the present disclosure.

Meanwhile, as illustrated in FIG. 16, the multiples buffering protrusions 150 and 250 may be formed on the inner surfaces of the first cover member 100 and the second cover member 200, respectively, of the present cover assembly. The buffering protrusions 150 and 250 function to suppress movement of the container caused by a micro gap which may be formed between the chemical container and the cover assembly. Further, the buffering protrusions 150 and 250 function to buffer an impact applied between the chemical container and the cover assembly.

A buffering member 450 may be attached to an upper inner surface of the cap 410 to buffer an impact applied to a lid of the chemical container when the cap 310 is in contact with the lid.

The buffering protrusions 150 and 250 and the buffering member 450 in the cover assembly suppress up-and-down and left-to-right movements of the chemical container and thus suppress or buffer an impact which may be applied to the chemical container and the cover assembly.

A method of coupling the above-described cover assembly and container will be described with reference to FIG. 11 and FIG. 12. The chemical container 1 is inserted into the second cover member 200. In a state where the chemical container 1 is inserted in the second cover member 200, the first cover member 100 is brought closer from above the chemical container 1 to apply a force in an insertion direction of the first cover member 100 in order for the second binding means formed at the second cover member 200 and the first binding means formed at the first cover member 100 to be airtightly fixed. The third cover member 400 to be connected to an upper part of the first cover member 100 may be previously connected thereto.

If the binding member 300 is airtightly fixed between the first cover member 100 and the second cover member 200, the binding member may be further sealed by winding a sealing tape (not illustrated) around an outer surface of the binding member 300. The sealing tape may include all kinds of tapes which can be allowed in semiconductor manufacturing plants. In other words, all of the tapes which can be allowed in semiconductor manufacturing plants can be applied as the sealing tape.

As described above, the present invention is configured such that the outside of a glass bottle accommodating chemical is formed with a protection member capable of being combined into two or more layers, thereby suppressing a negative influence on the surroundings thereof by minimizing leakage of the solution to the outside even if the glass bottle is broken by an impact when a worker handles or moves the glass bottle.

While the present disclosure has been described above with reference to the exemplary embodiments, various changes and modifications and equivalents thereof can be used. It is clear that the present disclosure can be equally applied by properly modifying the embodiments. Therefore, the above description does not limit the scope of the present disclosure defined by the appended claims.

Meanwhile, the embodiments have been described specifically in the detailed description of the invention. However, it is obvious to those skilled in the art that various modifications can be made without departing from the scope of the present disclosure.

I claim:

1. A cover assembly for protecting an inner container accommodating a high-purity chemical used in a semiconductor manufacturing process, comprising:

a first cover member encompassing a part of the inner container;

a second cover member encompassing the other part of the inner container; and a binding member that connects the first cover member and the second cover member, wherein the binding member includes a binding body formed at any one of the first cover member and the second cover member and coupled to the other.

2. The cover assembly of claim 1, further comprising:

a handle capable of being detached from any one of the first cover member and the second cover member.

3. The cover assembly of claim 1, further comprising:

a handle for moving which is integrally coupled to any one of the first cover member and the second cover member, wherein if the handle for moving is provided in an even number, the even number of handles for moving is arranged to face each other in pairs.

4. The cover assembly of claim 1, wherein each of the first cover member and the second cover member is formed of a material including one of polyethylene (PE), polypropylene (PP), polystyrene (PS), polyvinylidene chloride (PVDC), polyethyleneterephthalate (PET), polymethylmethacrylate (PMMA), phenolic resins (phenolformaldehyde (PF)), melamine resins (melamineformaldehyde (MF)), urea resins (ureaformaldehyde (UF)), polyacetal, polyoxymethylene (POM), polyformaldehyde, acrylic resins, polyamide/Nylon (PA/Nylon), polymethylpentene (PMP), polycarbonate (PC), polyvinylalcohol (PVA), polyvutene-1 (PB-1), butadien resins (BDR), acrylonitrile-butadiene styrene (ABS), acrylonitrile styrene (AS), polymethacrylstyrene (MS), polybutyleneterephthalate (PBT), polyarylsulfone (PASF), polyarylate (PAR), hydroxybutyl polyester (HBP), polyacrylonitrile (PAN), fluoro resins (FR) (PVDF, PTFE, FEP, PFA, ETFE, Teflon, ECTFE, PCTFE), polyphenyleneether (PPE), ionomer resins, fiber reinforced plastics (FRP), ethylenevinylacetate (EVA), methylmethacrylate-acrylonitrile-butadiene-styrene (MABS), polyethylenenaphthalate (PEN), silicone resins, epoxy resins, polyetherimide, polyphenylene sulfide (PPS), polyethersulfone (PES), poly(cyclohexane-1,4-dimethyleneterephthalate (PCT), ethylenevinylalcohol (EVOH), polyimide (PI), polyetheretherketone (PEEK), polylactide, polylactic acid (PLA), polybutylenesuccinate-co-adipate (PBSA), Ecozen, and TPE (Thermo Plastic Elastomer).

5. The cover assembly of claim 1, further comprising:

a third cover member arranged above the first cover member and the second cover member and encompassing an upper part of the inner container, wherein the third cover member includes a cap encompassing an inlet part of the inner container and a connection part connecting the cap to any one of the first cover member and the second cover member.

6. The cover assembly of claim 1, wherein multiple buffering protrusions are formed on inner surfaces of the first cover member and the second cover member, respectively, and the buffering protrusions suppress vibration of the inner container caused by a micro gap formed between the inner container and the first cover member and between the inner container and the second cover member.

* * * * *